US005609725A

United States Patent [19]

Van Phan

[11] Patent Number: 5,609,725

[45] Date of Patent: Mar. 11, 1997

[54] MULTI-REGION PAPER STRUCTURES HAVING A TRANSITION REGION INTERCONNECTING RELATIVELY THINNER REGIONS DISPOSED AT DIFFERENT ELEVATIONS, AND APPARATUS AND PROCESS FOR MAKING THE SAME

[75] Inventor: Dean Van Phan, West Chester, Ohio

[73] Assignee: The Procter & Gamble Company, Cincinnati, Ohio

[21] Appl. No.: 438,804

[22] Filed: May 11, 1995

Related U.S. Application Data

[62] Division of Ser. No. 268,133, Jun. 29, 1994, Pat. No. 5,549,790.

[51] Int. Cl.[6] ..... D21H 11/00

[52] U.S. Cl. ..... 162/117; 162/111

[58] Field of Search ..... 162/111, 117, 162/116, 109, 113

[56] References Cited

U.S. PATENT DOCUMENTS

| | | | |
|---|---|---|---|
| D. 239,137 | 3/1976 | Appleman | D59/2 A |
| 3,163,575 | 12/1964 | Nobbe | 162/111 |
| 3,300,368 | 1/1967 | Cooper et al. | 162/113 |
| 3,414,459 | 12/1968 | Wells | 161/131 |
| 3,537,954 | 11/1970 | Justus | 162/305 |
| 3,556,907 | 1/1971 | Nystrand | 156/470 |
| 3,867,225 | 2/1975 | Nystrand | 156/209 |
| 3,994,771 | 11/1976 | Morgan, Jr. et al. | 162/113 |
| 4,139,410 | 2/1979 | Tapio et al. | 162/206 |
| 4,144,124 | 3/1979 | Turunen et al. | 162/290 |
| 4,191,609 | 3/1980 | Trokhan | 162/113 |
| 4,239,065 | 12/1980 | Trokhan | 139/383 A |
| 4,309,246 | 1/1982 | Hulit et al. | 162/113 |
| 4,446,187 | 5/1984 | Eklund | 428/136 |
| 4,514,345 | 4/1985 | Johnson et al. | 264/22 |
| 4,528,239 | 7/1985 | Trokhan | 428/247 |
| 4,533,437 | 8/1985 | Curran et al. | 162/281 |
| 4,637,859 | 1/1987 | Trokhan | 162/109 |
| 4,740,409 | 4/1988 | Lefkowitz | 428/131 |
| 4,973,383 | 11/1990 | Filzen | 162/358 |
| 5,062,924 | 11/1991 | McCarten et al. | 162/358 |
| 5,115,544 | 5/1992 | Widen | 28/105 |
| 5,126,015 | 6/1992 | Pounder | 162/206 |
| 5,245,025 | 9/1993 | Trokhan et al. | 536/56 |
| 5,275,700 | 1/1994 | Trokhan | 162/358.1 |
| 5,277,761 | 1/1994 | Van Phan et al. | 162/109 |
| 5,328,565 | 7/1994 | Rasch et al. | 162/113 |
| 5,336,373 | 8/1994 | Scattolino et al. | 162/116 |

FOREIGN PATENT DOCUMENTS

| | | |
|---|---|---|
| 1099588 | 4/1981 | Canada . |
| 0604824A1 | 7/1994 | European Pat. Off. . |
| 0616074A1 | 9/1994 | European Pat. Off. . |
| 2254288 | 10/1992 | United Kingdom . |
| WO91/14558 | 10/1991 | WIPO . |
| WO92/17643 | 10/1992 | WIPO . |
| WO94/04750 | 3/1994 | WIPO . |
| WO94/06623 | 3/1994 | WIPO . |

*Primary Examiner*—Brenda A. Lamb
*Attorney, Agent, or Firm*—Gerry S. Gressel; Larry L. Huston; E. Kelly Linman

[57] ABSTRACT

A multi-region paper structure having a transition region interconnecting relatively thinner regions is disclosed. The paper structure comprises a first region, a patterned second region, a third region, and transition region. The transition region interconnects the patterned second region with a background matrix. The background matrix comprises the first region and the third region. The first region comprises a plurality of discrete protuberances dispersed throughout the third region. The first and second regions are disposed at different elevations, and each has a thickness less than a thickness of the transition region. An apparatus and process for making the paper structure is also disclosed.

6 Claims, 12 Drawing Sheets

MULTI-REGION PAPER STRUCTURES HAVING A TRANSITION REGION INTERCONNECTING RELATIVELY THINNER REGIONS DISPOSED AT DIFFERENT ELEVATIONS, AND APPARATUS AND PROCESS FOR MAKING THE SAME

This is a divisional of application Ser. No. 08/268,133, filed on Jun. 29, 1994 now U.S. Pat. No. 5,549,790.

FIELD OF THE INVENTION

The present invention relates to a multi-region paper structure having a transition region interconnecting regions of the paper structure disposed at different elevations and having thicknesses less than or equal to the thickness of transition region. The apparatus and process for making such a paper web also form part of the present invention.

BACKGROUND OF THE INVENTION

Paper structures, such as toilet tissue, paper towels, and facial tissue, are widely used throughout the home and industry. Many attempts have been made to make such tissue products more consumer preferred. One approach to providing consumer preferred tissue products having bulk and flexibility is illustrated in U.S. Pat. No. 3,994,771 issued Nov. 30, 1976 to Morgan et al. Improved bulk and flexibility may also be provided through bilaterally staggered compressed and uncompressed zones, as shown in U.S. Pat. No. 4,191,609 issued Mar. 4, 1980 to Trokhan.

Another approach to making tissue products more consumer preferred is to dry the paper structure to impart greater bulk, tensile strength, and burst strength to the tissue products. Examples of paper structures made in this manner are illustrated in U.S. Pat. No. 4,637,859 issued Jan. 20, 1987 to Trokhan. Alternatively, a paper structure can be made stronger, without utilizing more cellulosic fibers, by having regions of differing basis weights as illustrated in U.S. Pat. No. 4,514,345 issued Apr. 30, 1985 to Johnson, et. al. Papermaking belts having a semicontinuous pattern and paper made on such belts are disclosed in PCT Publication WO 94/04750 published Mar. 3, 1994 in the name of Ayers et al., and having a U.S. priority date of Aug. 26, 1992. Papermaking belts made using a deformable casting surface process are disclosed in U.S. Pat. No. 5,275,700 issued Jan. 4, 1994 to Trokhan.

Tissue paper manufacturers have also attempted to make tissue products more appealing to consumers by improving the aesthetic appearance of the product. For example, embossed patterns formed in tissue paper products after the tissue paper products have been dried are common. One embossed pattern which appears in cellulosic paper towel products marketed by the Procter and Gamble Company is illustrated in U.S. Pat. No. Des. 239,137 issued Mar. 9, 1976 to Appleman. Embossing methods and/or embossed products are also disclosed in U.S. Pat. No. 3,556,907 issued Jan. 19, 1971 to Nystrand; U.S. Pat. No. 3,867,225 issued Feb. 18, 1975 to Nystrand; and U.S. Pat. No. 3,414,459 issued Dec. 3, 1968 to Wells.

However, embossing a dry paper web typically imparts a particular aesthetic appearance to the paper structure at the expense of other properties of the structure. In particular, embossing disrupts bonds between fibers in the cellulosic structure. This disruption occurs because the bonds are formed and set upon drying of the embryonic fibrous slurry. After drying the paper structure, moving fibers normal to the plane of the paper structure by embossing breaks fiber to fiber bonds. Breaking bonds results in reduced tensile strength of the dried paper web. In addition, embossing is typically done after creping of the dried paper web from the drying drum. Embossing after creping can disrupt the creping pattern imparted to the web. For instance, embossing can eliminate the creping pattern in some portions of the web by compacting the creping pattern. Such a result is undesirable because the creping pattern improves the softness and flexibility of the dried web.

In addition, dry embossing a paper structure acts to stretch or draw the paper structure around the perimeter of the embossments. As a result, the paper structure around the perimeter of the embossments will have a reduced thickness relative to the non-embossed portion of the paper web.

U.S. patent application Ser. No. 07/718,452, Tissue Paper Having Large Scale, Aesthetically Discernible Patterns and Apparatus for Making Same, filed Jun. 19, 1991 to be issued as U.S. Pat. No. 5,328,565 on Jul. 12, 1994 in the name of Rasch et al. discloses a single lamina paper structure having at least three visually discernible regions. Rasch et al. teaches the three regions are visually distinguishable by an optically intensive property such as crepe frequency, elevation, or opacity. While the structures of Rasch et al. provide an improvement over embossed paper structures, there is a need to provide tissue products having improved visually discernible patterns over those taught in Rasch et al. Therefore, those involved in the papermaking field continue to search for ways to make paper structures having highly discernible aesthetic patterns without sacrificing desirable paper web properties.

Accordingly, one object of the present invention is to provide a paper structure having visually discernible patterns without the need for embossing a dried paper web.

Another object of the present invention is to provide a paper structure having visually discernible patterns without sacrificing desirable paper web properties such as tensile strength and sheet flexibility.

Another object of the present invention is to provide a paper structure having a first region disposed at a first elevation and having a first thickness, a second region disposed at a second elevation different from the first elevation and having a second thickness, a third region disposed at a third region and having a third thickness greater than the first thickness, and a fourth transition region interconnecting the second region with at least one of the first and third regions, the transition region having a fourth thickness greater than the second thickness and greater than or equal to the first thickness.

Another object of the present invention is to provide an apparatus and method for forming the paper structure of the present invention.

Another object of the present invention is provide a paper structure characterized in having enhanced bulk caliper and roll compressibility.

SUMMARY OF THE INVENTION

The invention comprises a paper structure, such as a tissue paper web, having visually discernible patterns. The paper structure comprises a first region disposed at a first elevation and having a first thickness; a patterned second region disposed at a second elevation different from the first elevation, the second region having a second thickness; a third region interconnected with the first region, the third region disposed at a third elevation different from the second elevation, and the third region having a third thickness; and a transition region having a fourth thickness. The transition region interconnects the second region with at least one of the first and third regions. The fourth thickness is greater than or equal to the first thickness and is greater than the second thickness. The third thickness is greater than the first thickness. In one embodiment the first elevation is different from the third elevation, and paper structure has a background matrix comprising the first and third regions, wherein the first region comprises a plurality of discrete protuberances dispersed throughout the third region.

A portion of at least one of the second regions and the background matrix can be foreshortened, such as by creping. In one embodiment at least a portion of the second region is bordered by a variable frequency creping pattern. The variable frequency creping pattern extends from a border of the second region into the a background matrix comprising the first and third regions. The variable frequency creping pattern terminates in the background region, and enhances the visual discernibility of the patterned second region. The second region can comprise a continuous network, discrete zones, or combinations thereof.

The present invention also comprises an apparatus for use in making a web of papermaking fibers. The apparatus can comprise a drying belt. The drying belt comprises a foraminous background element having a first web contacting surface and a web patterning layer joined to the foraminous background element, the web patterning layer extending from the first web contacting surface to form a second web contacting surface at a second elevation different from the first elevation. The web patterning layer is disposed in a predetermined pattern to inscribe a portion of the foraminous background element having a projected area of at least about 50 square millimeters, and more preferably at least about 100 square millimeters, wherein the elevation everywhere within the inscribed area is the first elevation of the first web contacting surface, and wherein there is no web patterning layer within the inscribed area. The projected area of the second web contacting surface is preferably between about 5 and about 20 percent of the projected area of the apparatus, and more preferably between about 5 and about 14 percent of the projected area of the apparatus. The apparatus having a web patterning layer with the above projected area and disposed to inscribe portions of the foraminous background element with the above width and area is relatively flexible. Such flexibility permits deflection of the first web contacting surface relative to the second web contacting surface for formation of compacted, relatively high density regions at different elevations.

The present invention also comprises a method for forming a paper structure according to the present invention. The method comprises the following steps:

providing a wet web of paper making fibers;

deflecting the web in a first deflection step to provide a non-monoplanar web having a first uncompacted web region, and a second uncompacted web region having an elevation different from the elevation of the first uncompacted web region while the web has a consistency of between about 8 and about 30 percent.

deflecting first uncompacted web region relative to the second uncompacted web region in a second deflection step to temporarily reduce, and preferably substantially eliminate, the difference in elevation between the first uncompacted web region and the second uncompacted web region;

compacting a predetermined portion of the first uncompacted web region at a web consistency of between about 40 to about 80 percent to provide a first compacted region and a third uncompacted region;

compacting at least a portion of the second uncompacted web region at a web consistency of between about 40 to about 80 percent to form a second compacted web region; and restoring at least some of the difference in elevation lost in the first deflection step to provide the first compacted region and the third uncompacted region disposed at elevations different from the elevation of the second compacted region.

DESCRIPTION OF THE DRAWINGS

While the Specification concludes with claims particularly pointing out and distinctly claiming the present invention, the invention will be better understood from the following description taken in conjunction with the associated drawings, in which like elements are designated by the same reference numeral, and:

DETAILED DESCRIPTION OF THE INVENTION

Figure 7:
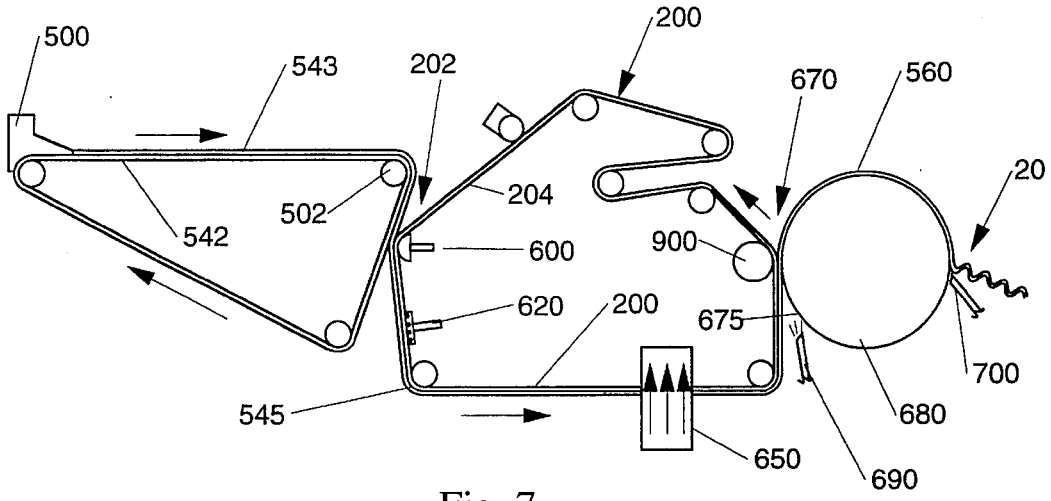
FIG. 7 is an illustration of a papermaking machine for making a paper structure according to the present invention.
Figure 8:
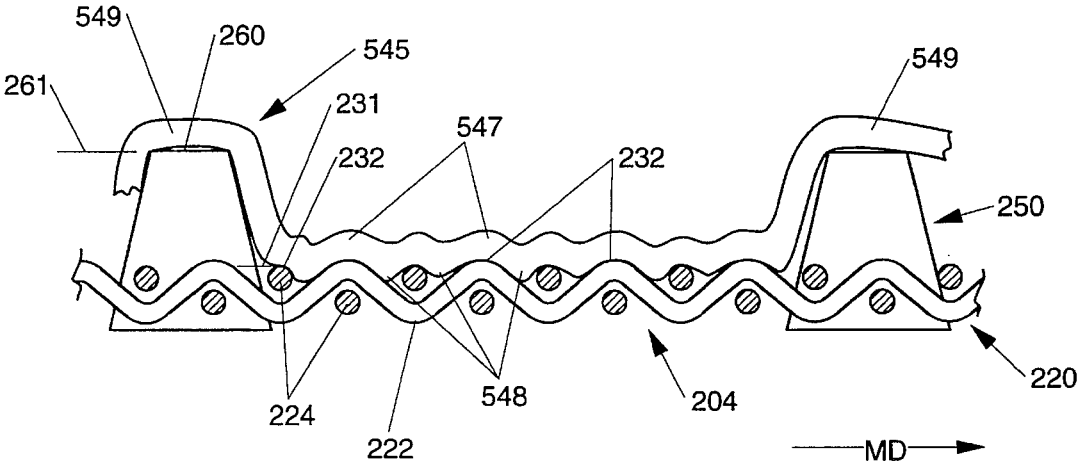
FIG. 8 is an illustration of a non-monoplanar, generally uncompacted paper web supported on the apparatus of FIG. 6.
Figure 9:
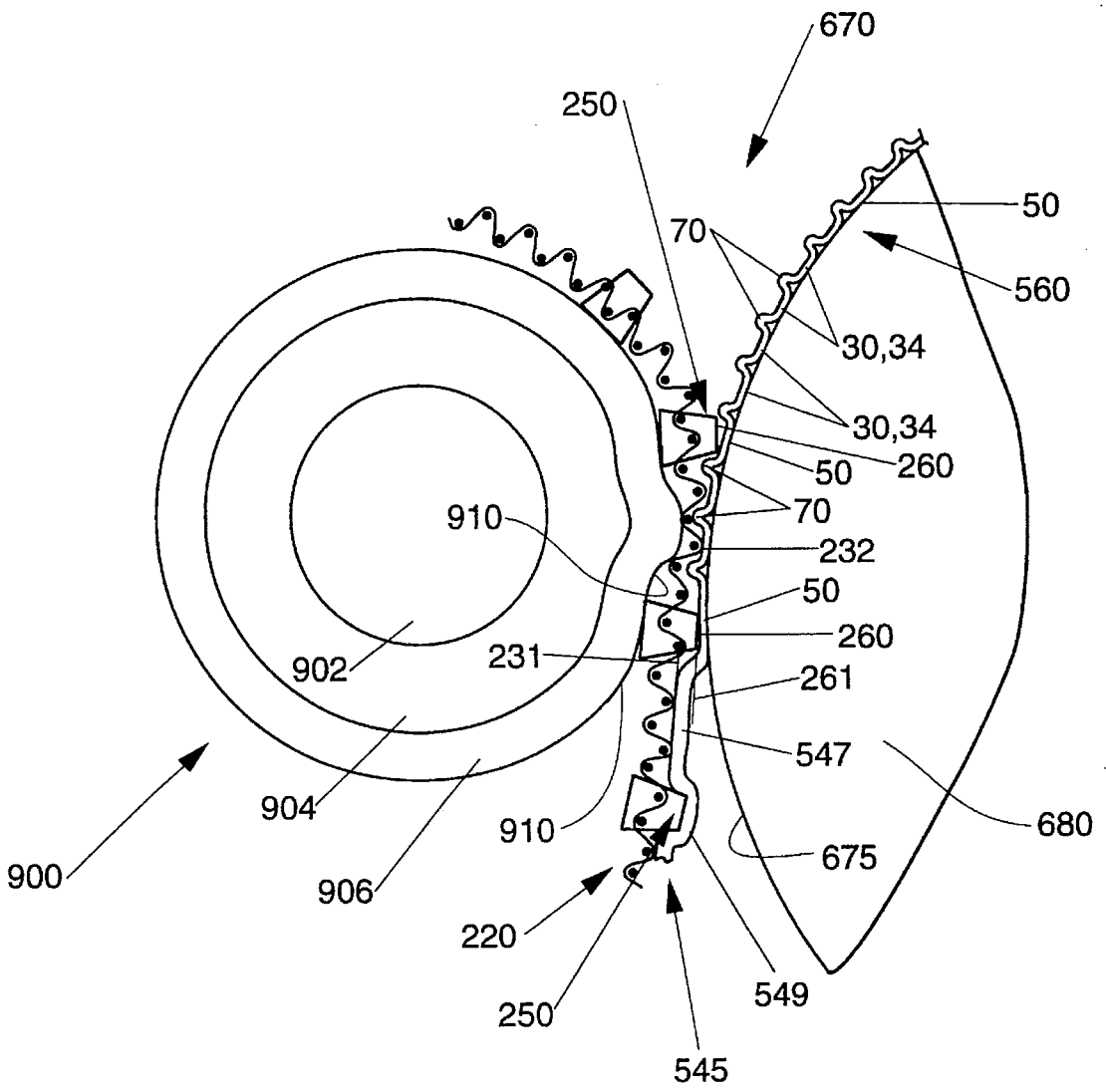
FIG. 9 is an illustration of a paper web being compacted against the surface of a drying drum.

FIGS. 1–4 and 10 illustrate a paper structure 20 according to the present invention. FIGS. 5–6 and 11 illustrate a web support apparatus 200 suitable for making paper structures according to the present invention. FIGS. 7–9 illustrate a method employing the web support apparatus 200 for making the paper structure 20.

Paper Structure

A paper structure according to the present invention is taken off the forming wire as a single sheet having one or more fiber constituent layers. Though not necessary, the paper structure of the present invention can be joined to one or more other sheets or plies after sheet drying to form a multi-ply paper product. A "zone" as used herein refers to a contiguous portion of the paper structure. A "region" of a paper structure, as used herein, refers to a portion or portions of the paper structure having a common property or characteristic, such as density, thickness, elevation, or creping frequency. A region can comprise one or more zones, and can be continuous or discontinuous.

Referring to FIGS. 1–4, the paper structure 20 according to the present invention comprises a tissue paper web having at least four regions. The paper structure 20 comprises a first region 30 having a first thickness 31 and disposed at a first elevation 32; a patterned second region 50 having a second thickness 51 and disposed at a second elevation 52 different from the first elevation 32; and a third region 70 having a third thickness 71 and disposed at a third elevation 72. The difference between elevation 52 and elevation 32 is indicated by reference numeral 62 in FIGS. 1–2. The third region 70 is interconnected with the first region 30, and together the first and third regions 70 form a background matrix 100 of the paper structure 20. The paper structure 20 Further comprises a fourth transition region 90 having a fourth thickness 91. The transition region 90 interconnects the second region 50 with at least one of the first and third regions 30 and 70 of the background matrix 100, and thereby supports the second region 50 at the elevation 52 such that the second region 50 is visually distinguishable from the background matrix 100 of the paper structure formed by the first region 30 and the third region 70.

Figure 1:
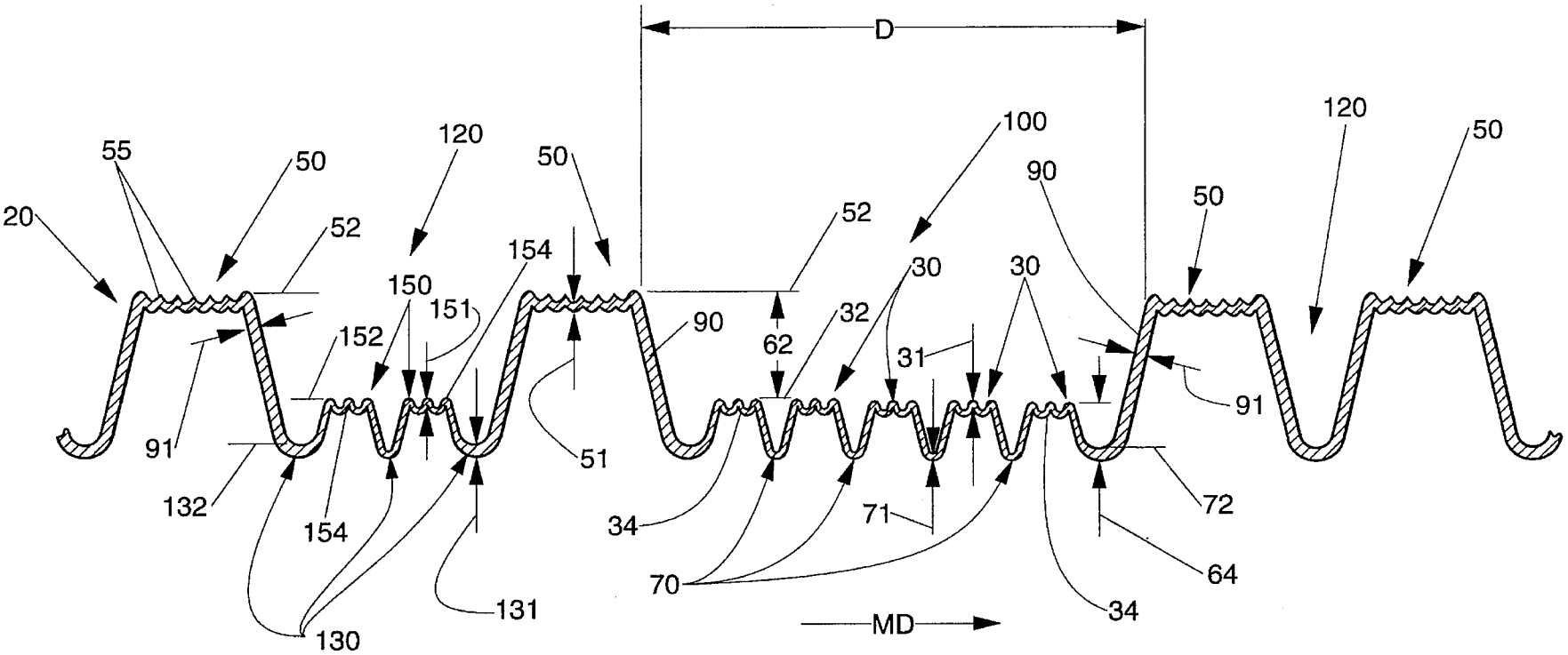
FIG. 1 is a cross-sectional illustration of a paper structure according to the present invention.

Referring to FIGS. 1–2, the paper structure 20 is characterized in that the fourth thickness 91 of the transition region 90 is greater than or equal to the first thickness 31, the fourth thickness 91 is greater than the second thickness 51; and the third thickness 71 is greater than the first thickness 31. Accordingly, the paper structure 20 of the present invention does not exhibit the reduced web thinning around the perimeter of raised portions of the paper structure characteristic of embossing. The thicknesses 31, 51, 71, and 91 and the difference in elevation 62 are measured using the procedure described below. In one embodiment the fourth thickness 91 is greater than both the first thickness 31 and the second thickness 51. The fourth thickness 91 can be at least about 1.2 and preferably at least about 1.5 times the first thickness 31, and the fourth thickness can be at least about 1.5 times and preferably at least about 2.0 times the second thickness 51. The first and second thicknesses 31 and 51 can be less than the third thickness 71.

The first elevation 32 can he different from the third elevation 72. In the embodiment shown in FIGS. 1–4, the first region 30 comprises a plurality of discrete protuberances 34 (FIGS. 2A–B and 4C) dispersed throughout the third region 70. The first region 30 and the second region 50 can be formed by selectively deflecting and compacting a wet web of paper making fibers. For a web having a generally constant basis weight and first and second regions 30 and 50 with thicknesses 31 and 51 less than the third thickness 71 and the fourth thickness 91, the first and second regions 30 and 50 can be characterized as relatively high density regions and the third and fourth regions 70 and 90 can be characterized as relatively low density regions.

Figure 3:
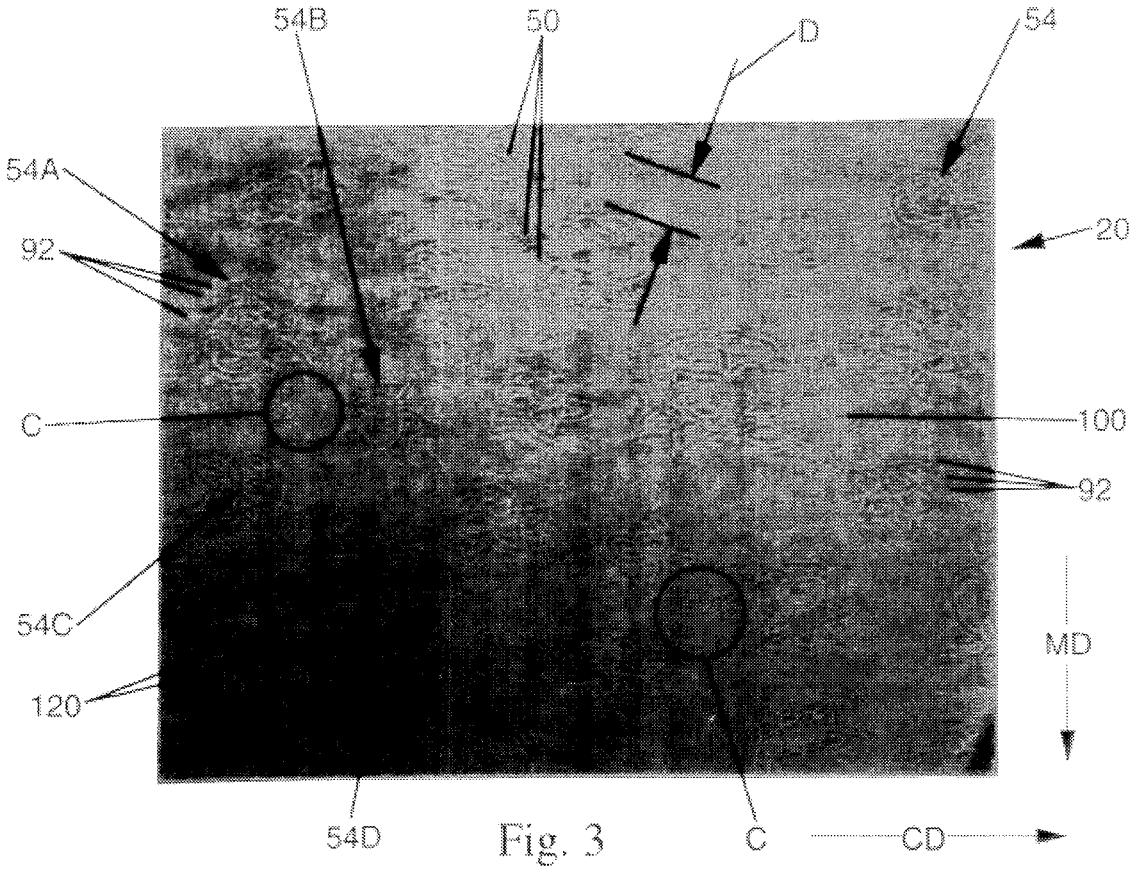
FIG. 3 is a photographic plan view of a paper structure according to the present invention.

Referring to FIGS. 3–4, the second region 50 can comprise a plurality of discrete zones 54 dispersed throughout the background matrix 100, with each discrete zone 54 surrounded by the background matrix 100. The third region 70 can comprise a generally continuous network extending in the machine (MD)) and cross-machine (CD) directions throughout the background matrix 100.

As viewed in FIGS. 3 and 4A–C, each of the zones 54 has a projected area which is at least about 10 times, and preferably at least about 100 times the projected area of one of the protuberances 34. The projected areas of a protuberance 34 and a zone 54 can be measured using standard image analysis procedures. FIG. 3 shows a number of discrete zones 54 (e.g., zones 54A–D). In the plan views of FIGS. 3 and 4A, each discrete zone 54 has the form of a flower shaped pattern.

Figure 2A:
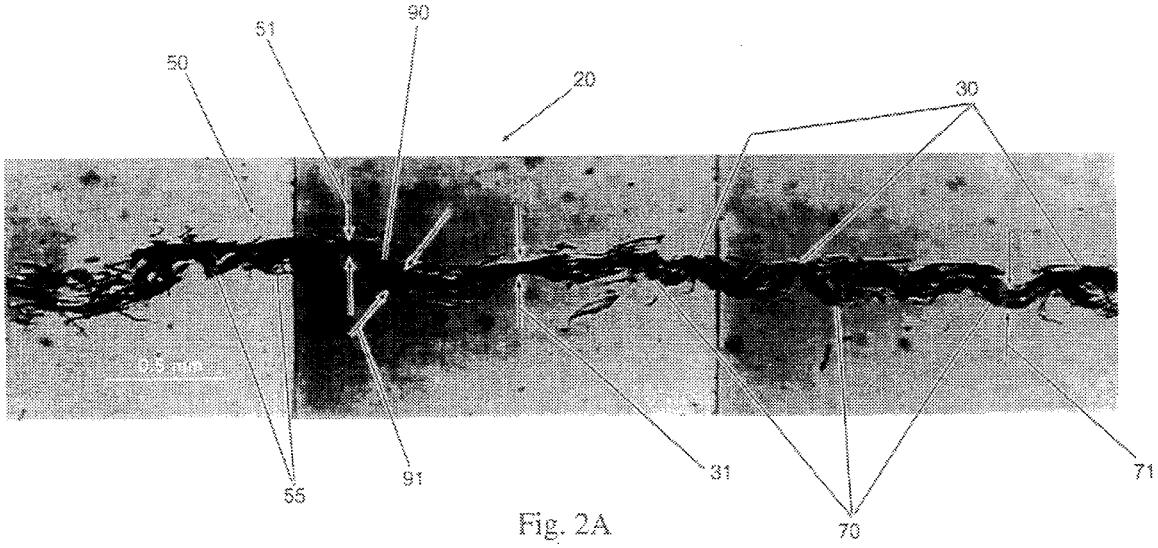
FIG. 2A is a photomicrograph of a cross-section of a paper structure according to the present invention.
Figure 2B:
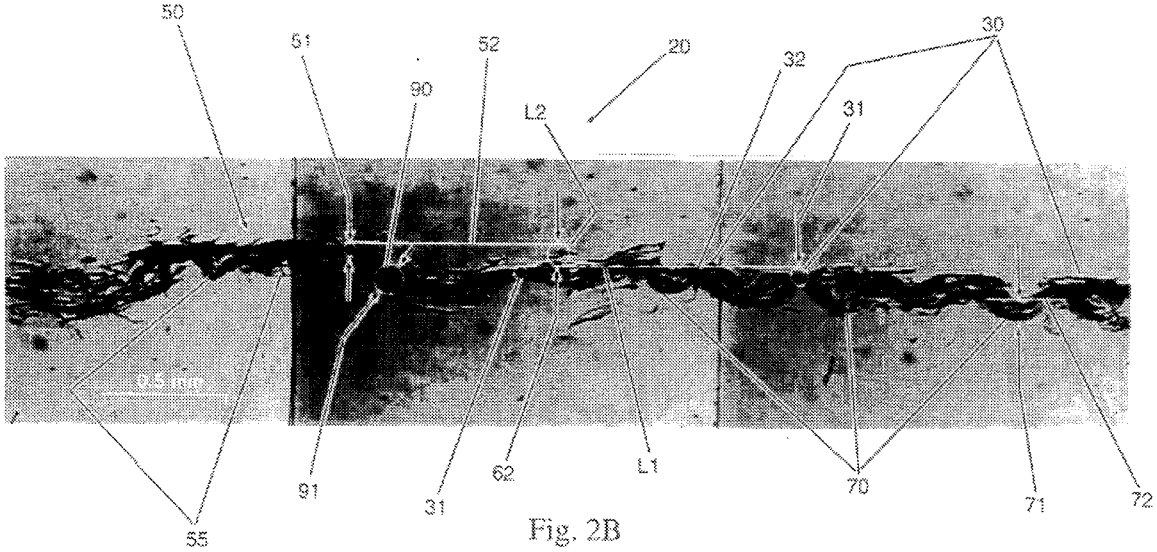
FIG. 2B is the photomicrograph of FIG. 2A showing thickness and elevation reference lines.

The difference between the first elevation 32 and the second elevation 52 is preferably at least about 0.05 millimeter, and more preferably at least about 0.08 millimeter. The elevations 32 and 52 and the thicknesses 31, 51, 71, and 91 are indicated in the photomicrographs of FIGS. 2A and 2B.

Preferably at least a portion of at least one of the second region 50 and the background matrix 100 is foreshortened in the machine direction of the structure 20. Foreshortening can be provided by creping a paper web with a doctor blade, as described below. The machine direction (MD)) and the cross-machine direction (CD) are indicated in FIGS. 1–4. Foreshortened portions of the paper structure 20 are characterized by having a creping pattern having a creping frequency. The creping pattern of a portion of the background matrix 100 is indicated by reference numeral 35 in FIG. 1 and FIG. 4B, and is characterized by a series of peaks and valleys. The creping pattern of the second region 50 is indicated by reference numeral 55 in FIGS. 1 and 2A, and is characterized by a series of peaks and valleys. The creping pattern 35 in a portion of the background matrix 100 is disposed at a different elevation than the creping pattern 55 of the second region 50. The crepe frequency of a creping pattern is defined as the number of times a peak occurs on the surface of the paper structure For a given linear distance, and can be measured in cycles per millimeter of linear distance.

Figure 4A:
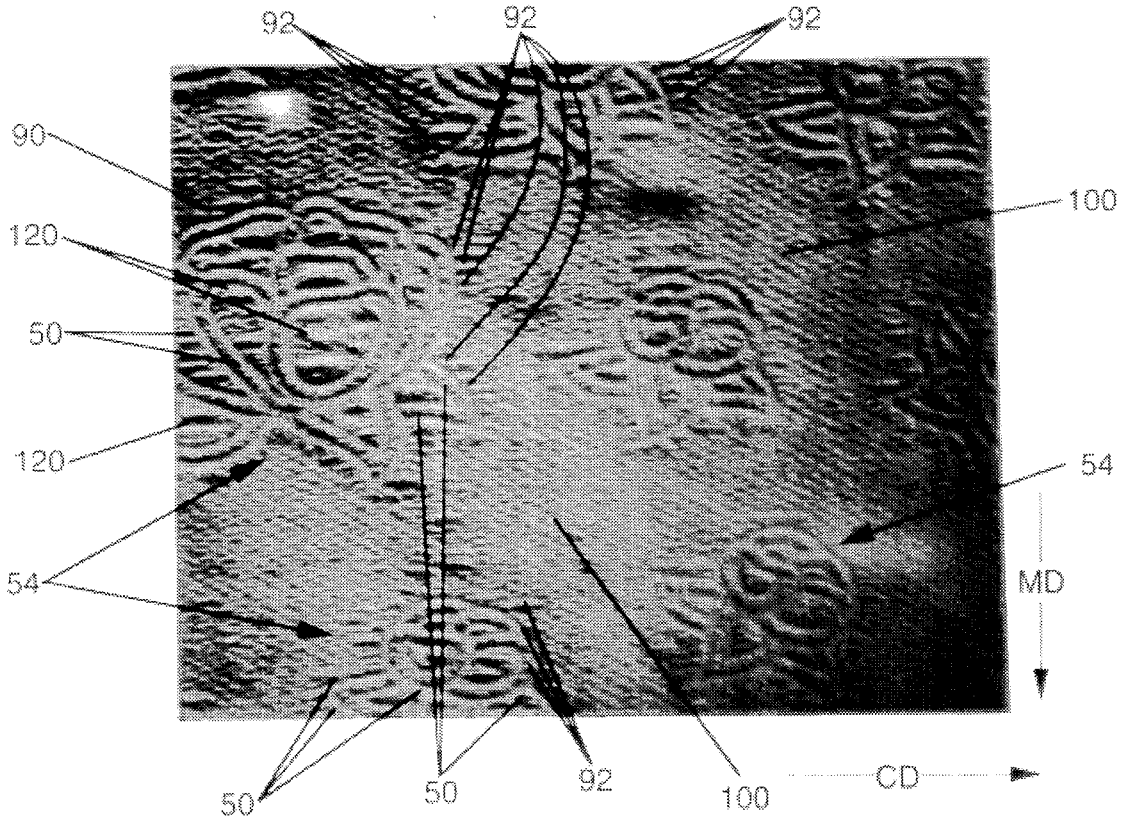
FIG. 4A is a photographic plan view of a portion of a paper structure according to the present invention, the view enlarged relative to FIG. 3.
Figure 4B:
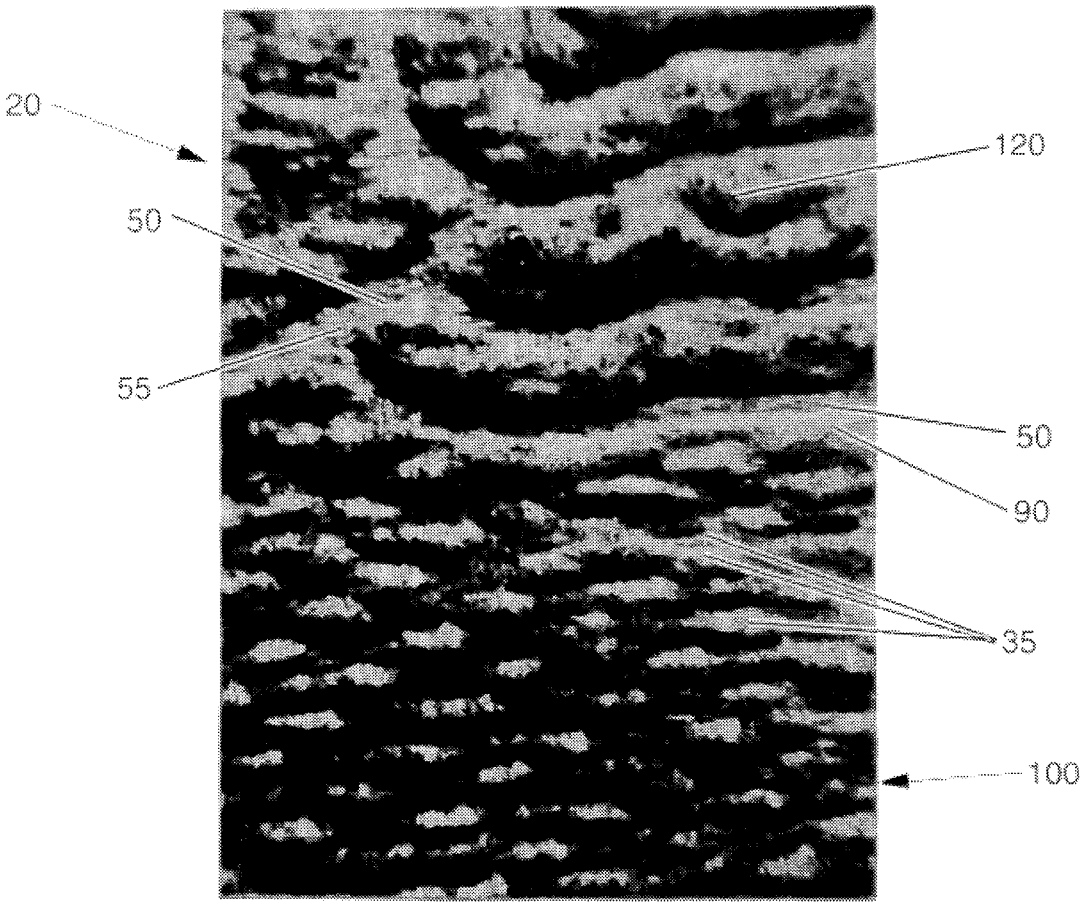
FIG. 4B is a photographic plan view of a portion of a paper structure according to the present invention, the view enlarged relative to FIG. 4A.
Figure 4C:
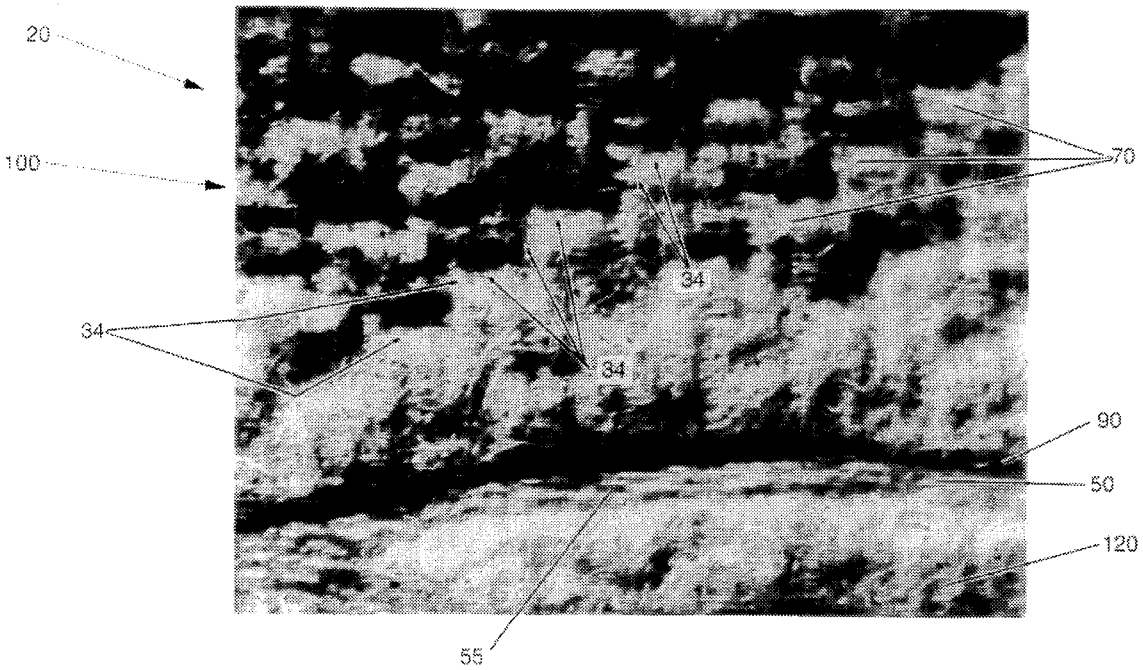
FIG. 4C is a photographic plan view of a portion of a paper structure according to the present invention, the view enlarged relative to FIG. 4B.

Referring to FIGS. 3 and 4A, at least a portion of the second region 50 can be bordered by a variable frequency creping region characterized by having a reduced creping frequency relative to the creping frequency of at least one of the creping patterns 35 and 55. The variable frequency creping region can comprise a portion of at least one of the background matrix 100 and the transition region 90 disposed adjacent the patterned second region 50. The variable frequency creping region extends from a portion of a border of the second region 50 into the background matrix 100, and terminates in the background matrix 100 The variable frequency creping region is visible in FIGS. 3 and 4A as wrinkles 92 bordering a portion of the discrete zones 54. The wrinkles 92 extend in the cross machine direction From a portion of the border of each discrete zone 54 and terminate in the background matrix 100. The creping pattern 55 can have a frequency of at least about 1.5 times the frequency of the wrinkle 92. The transition region 90 and the wrinkles 92 of the variable frequency creping region border the second region 50, and thereby help to visually offset the second region 50 from the background matrix 100.

The second region 50 preferably has a projected area between about 5 and about 20 percent, and more preferably between about 5 and about 14 percent of the projected area of the paper structure 20. The second region 50 inscribes one or more circular zones C (FIG. 3) of the background matrix 100 wherein the projected area of the circular zone C is at least about 50 square millimeters, and more preferably at least about 100 square millimeters. In the embodiment wherein the second region comprises discrete zones 54, the spacing D (FIGS. 1 and 3) between at least some adjacent zones 54 is preferably at least about 25 mm. The second region thereby imparts a relatively large-scale visually discernible pattern to the tissue web while comprising a relatively small percentage of the projected area of the tissue web.

As shown in FIGS. 1, 3, and 4A, at least some discrete zones 54 can enclose a plurality of discrete, unconnected enclosed zones 120. At least some of the enclosed zones 120 can comprise a fifth region 130 having an elevation 132 and a sixth region 150 having an elevation 152, as shown schematically in FIG. 1. The fifth region 130 can have a thickness 131 greater than the thickness 51. The sixth region 150 can comprise a plurality of protuberances 154 dispersed throughout the fifth region 130. The sixth region 150 can have a thickness 151 less than the thickness 131. The enclosed zone 120 can be foreshortened to have a creping pattern.

Figure 10:
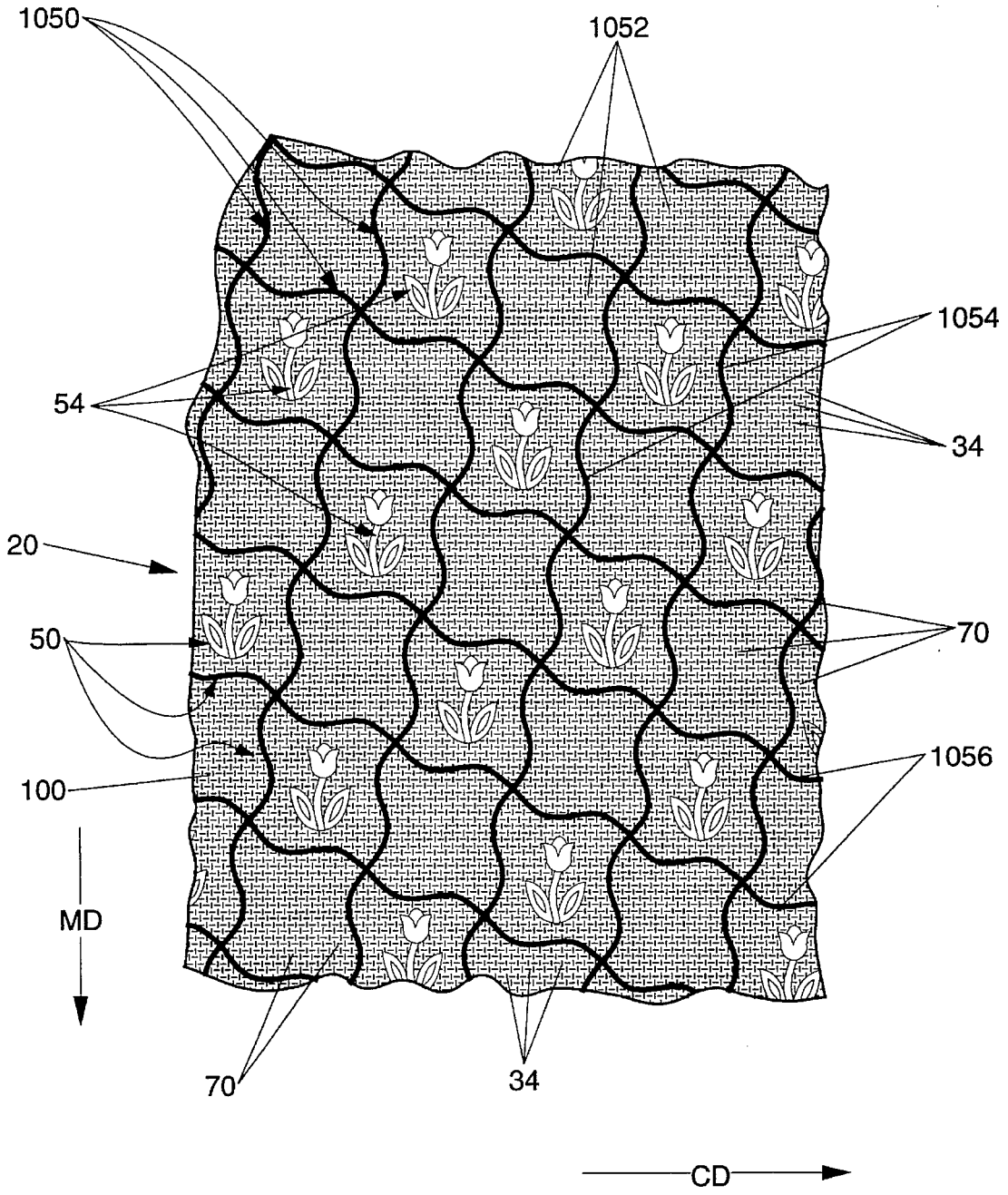
FIG. 10 is a plan view illustration of a paper structure having a second region comprising discrete zones disposed within cells in a lattice network.
Figure 11:
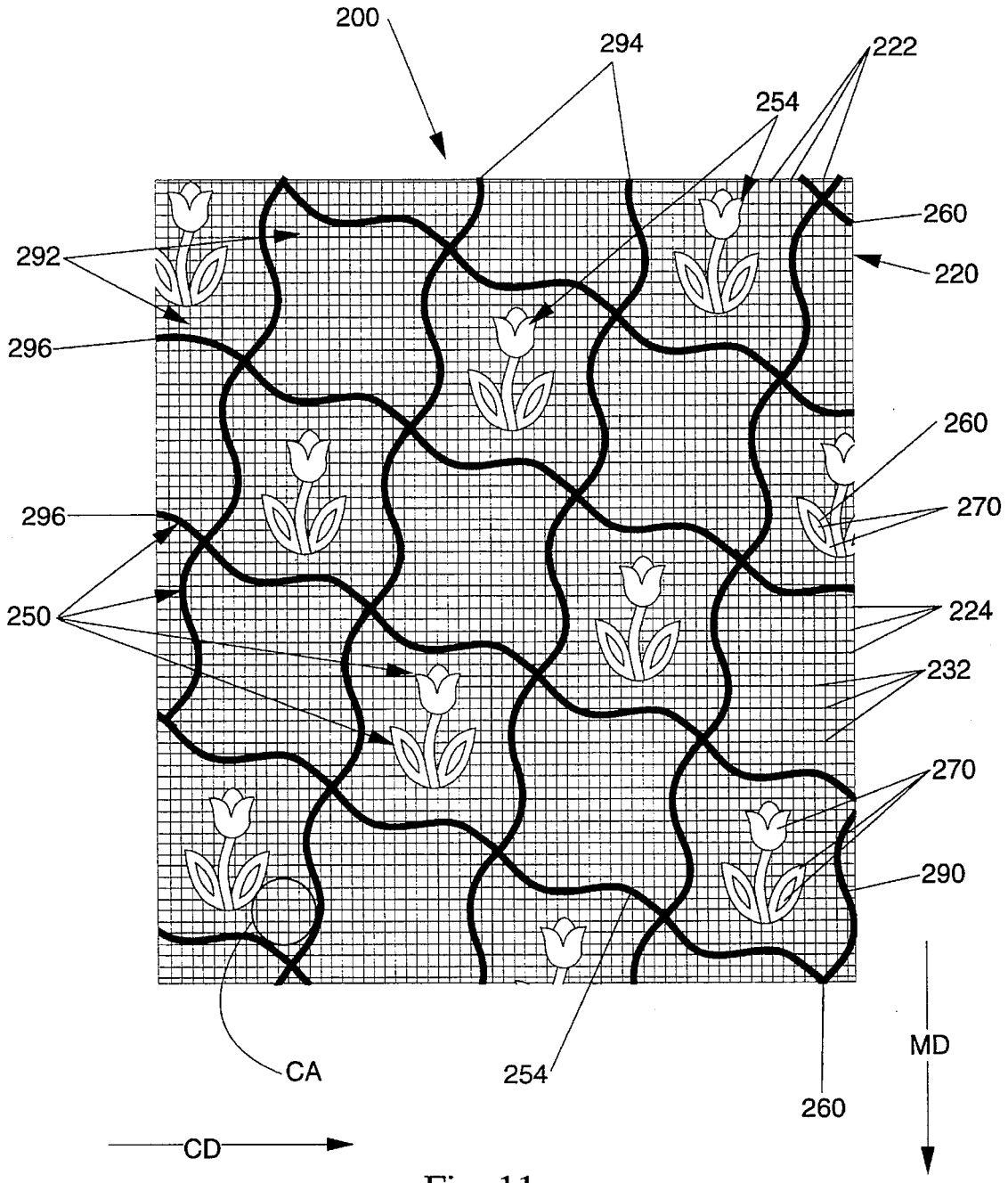
FIG. 11 is a plan view illustration of a web support apparatus for making the paper structure of FIG. 10.

FIG. 10 is a plan view illustration of an alternative embodiment of the paper structure 20 according to the present invention. As shown in FIG. 10, the second region 50 can comprise a lattice network 1050 defining cells 1052, and a plurality of discrete zones 54. The discrete zones 54 can be disposed within at least some of the cells 1052 of the lattice network 1050. A background matrix 100 within each cell 1052 can comprise the first region 30 and the third region 70. The third region 30 can comprise a plurality of discrete protuberances 34 dispersed throughout the third region 70 within each cell 1052.

The lattice network 1050 shown in FIG. 10 comprises spaced apart bands 1054 which intersect spaced apart bands 1056 to form the cells 1052. The bands 1054 and/or the bands 1054 can be unbroken, or alternatively, can be formed by a plurality of short, spaced apart segments. In FIG. 10 the bands 1054 and 1056 are unbroken. The bands 1054 extend generally in the machine direction, and the bands 1056 extend generally in the cross-machine direction. The intersecting, unbroken bands 1054 and 1056 thereby form a continuous network lattice 1050.

The paper structure 20 according to the present invention preferably has a basis weight of between about 7 pounds per 3000 square feet (about 11 gram/square meter) and about 35 pounds per 3000 square feet (57 gram/square meter), which basis weight range is desirable for providing paper structures 20 suitable for use bath tissue and facial tissue products. The basis weight of the paper structure 20 is measured by cutting eight single ply samples of the paper structure 20 conditioned at 73 degrees Fahrenheit and 50 percent relative humidity, each sample measuring 4 inches by 4 inches (0.0103 square meter). The eight 4 inch by 4 inch samples are placed one on top of each other and weighed to the nearest 0.0001 gram. The basis weight of the eight samples (in grams/square meter) is the combined weight of the eight samples in grams divided by the sample area of 0.0103 square meter. The basis weight of the paper structure 20 is obtained by dividing the combined basis weight of eight samples by eight.

Web Support Apparatus

Figure 5A:
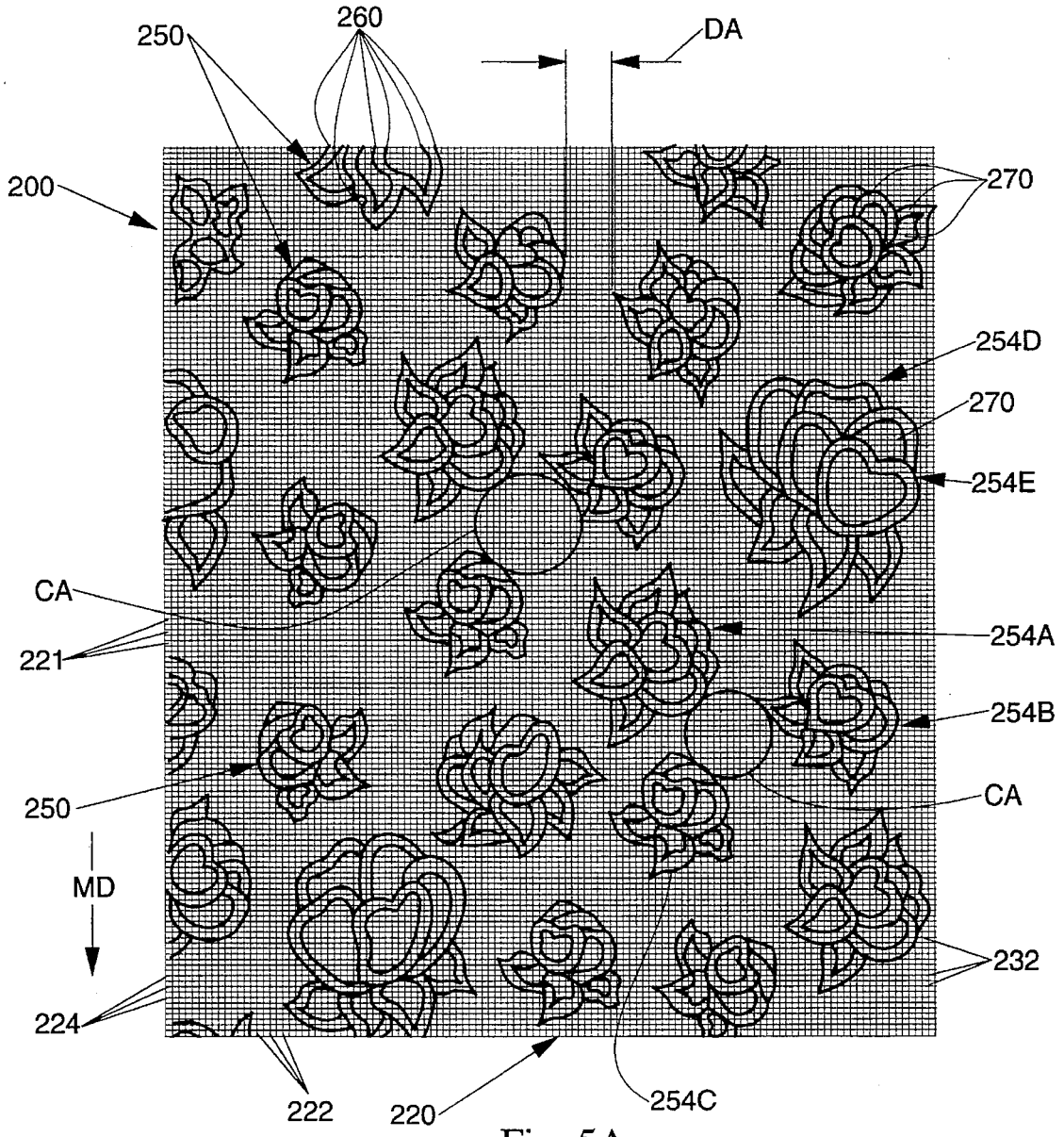
FIG. 5A is a plan view illustration of an apparatus for making a paper structure according to the present invention, the apparatus having a foraminous background element and a web patterning layer extending from the foraminous background element.
Figure 5B:
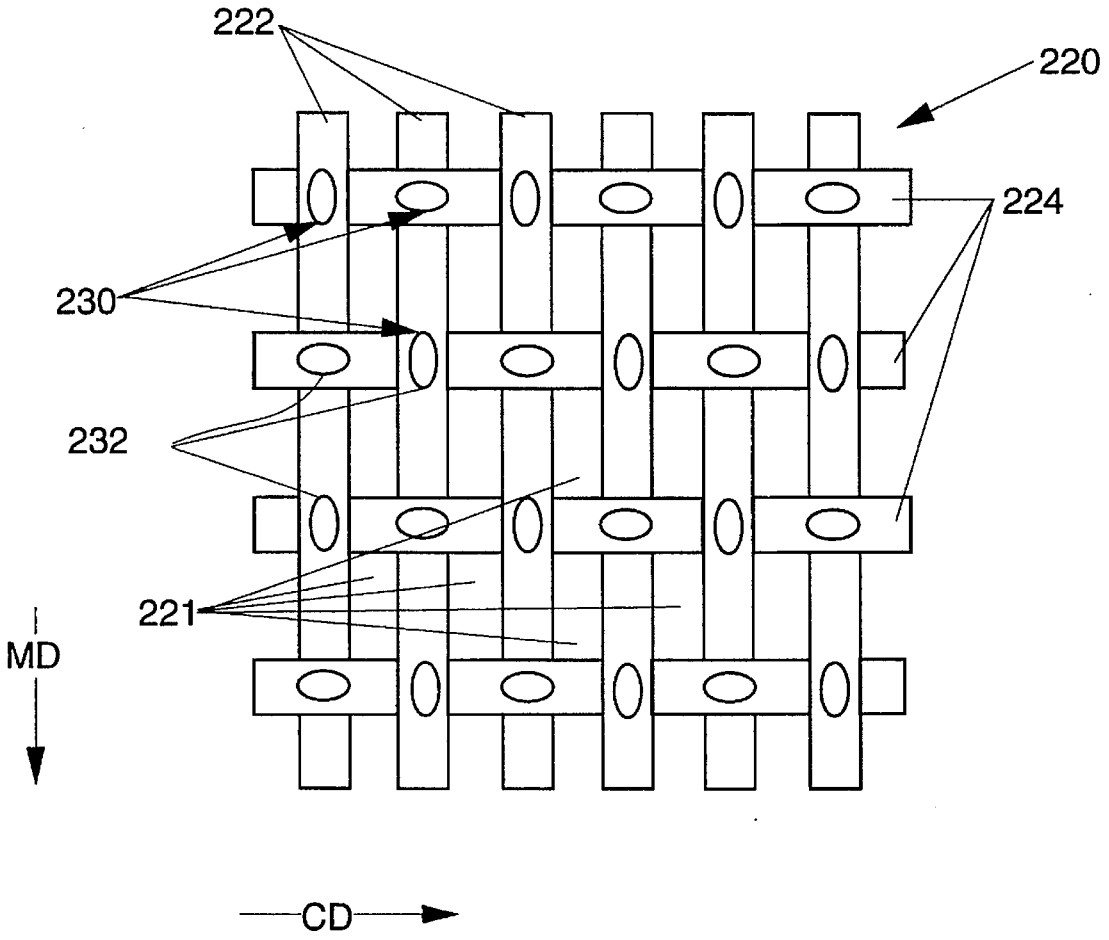
FIG. 5B is an enlarged plan view illustration of a portion of a foraminous background element.
Figure 6:
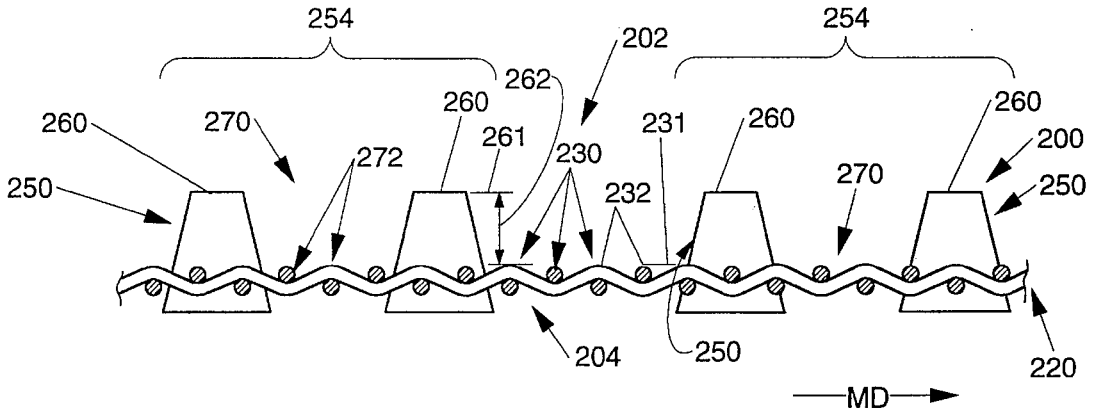
FIG. 6 is a cross-sectional view of the apparatus of FIG. 5A.

A web support apparatus 200 suitable for making the paper structure 20 is shown in FIGS. 5A–B and 6. The web support apparatus 200 can comprise a continuous drying belt (FIG. 7) for drying and imparting a visually discernible pattern to the paper structure 20. The web support apparatus 200 has a first web facing side 202 and a second oppositely facing side 204 (FIG. 6). The web support apparatus 200 is viewed with the first web facing side 202 facing the viewer in FIG. 5A.

Referring to FIG. 6, the web support apparatus 200 comprises a foraminous background element 220 having a first web contacting surface 230 at a first elevation 231. A plan view of the foraminous background element 220 is shown in FIG. 5B. The web support apparatus 200 also comprises a web patterning layer 250 joined to the foraminous background element 220. The web patterning layer 250 extends from the first web contacting surface 230 to form a second web contacting surface 260 at a second elevation 261 different from the first elevation 231. The difference 262 between the first elevation 231 and the second elevation 261 is at least about 0.05 millimeter and preferably between about 0.1 and about 2 mm.

The projected area of the second web contacting surface 260 is between about 5 and about 20 percent, and more preferably between about 5 and about 14 percent of the projected area of the apparatus 200 as viewed in FIG. 5A. The projected area of the first web contacting surface 230 is preferably between about 10 and about 40 percent of the projected area of the apparatus. The web patterning layer 250 is disposed on the foraminous background element 220 in a predetermined pattern to inscribe a plurality of circular portions CA (FIG. 5A) of the foraminous background element 220 which are not covered by the web patterning layer 250, wherein the projected area of each circular portion CA is at least about 50 square millimeters, and more preferably at least about 100 square millimeters. The elevation of the apparatus 200 everywhere within a circular portion CA is less than the elevation 261.

The belt apparatus 200 having a web patterning layer 250 with the above projected area and disposed to inscribe portions of the foraminous background element with the above area is relatively flexible compared to a belt made from the same underlying foraminous element but having a larger percentage of its surface covered by a web patterning layer. Such flexibility permits deflection of the first web contacting surface 230 relative to the second web contacting surface 260 for formation of relatively high density regions at different elevations, as described below.

In the embodiment shown in FIG. 5A, the web patterning layer 250 comprises a plurality of discrete web patterning elements 254, such as discrete elements 254A–C which inscribe a circular portion CA of the foraminous background element 220. A discrete element 254 can enclose one or more other discrete elements 254. For instance, in FIG. 5A, a discrete element 254E is disposed within a discrete element 254D.

The spacing DA between some adjacent web patterning elements 254 is preferably at least about 25 millimeters. Two web patterning elements 254 are considered to be adjacent if the shortest straight line that can be drawn between the two elements does not intersect a third element. In FIG. 5A, at least some of the web patterning elements 254 enclose a plurality of discrete openings 270 in the web contacting surface 260 of the web patterning layer 250. Each of the enclosed openings 270 has a web facing surface 272 (FIG.

6) comprising a portion of the foraminous background element 220.

The web support apparatus 200 preferably has an air permeability of between about 400 and about 800 standard cubic feet per minute (scfm), where the air permeability in scfm is a measure of the number of cubic feet of air per minute that pass through a one square foot area of the apparatus 200 at a pressure drop across the thickness of the apparatus 200 equal to about 0.5 inch of water. The air permeability is measured using a Valmet permeability measuring device (Model Wigo Taifun Type 1000) available from the Valmet Corporation of Pansio, Finland.

It is desirable that the apparatus 200 have the air permeability listed above so that the web support apparatus 200 can be used with a paper making machine having a vacuum transfer section and a through air drying capability, as described below.

The foraminous background element 220 shown in FIGS. 5B and 6 comprises woven filaments 222 and 224. The filaments 222 extend generally in the machine direction, and the filaments 224 extend generally in the cross-machine direction. Referring to FIGS. 5B and 6, the first web contacting surface 230 comprises discrete web contacting knuckles 232 located at the cross-over points of the woven filaments 222 and 224. The knuckles 232 form a generally monoplanar web contacting surface 230. Between about 5 and about 50 percent of the projected area of the foraminous background element 220 comprises open area corresponding to openings 221 between adjacent filaments 222 and 224.

The foraminous background element 220 preferably has between about 25 and about 100 of the filaments 222 per inch measured in the cross machine direction and between about 25 and about 100 of the filaments 224 per inch measured in the machine direction, where the filaments 222 and the filaments 224 have a diameter between about 0.1 and about 0.5 millimeter. The foraminous background element preferably comprises between about 625 and about 10,000 discrete web contacting knuckles per square inch of the projected area of the foraminous background element.

The filaments 222, 224 can be formed from a number of different materials. Suitable filaments and filament weave patterns for forming the foraminous background element 220 are disclosed in U.S. Pat. No. 4,191,609 issued Mar. 4, 1980 to Trokhan, and U.S. Pat. No. 4,239,065 issued Dec. 16, 1980 to Trokhan, which patents are incorporated herein by reference.

The web patterning layer 250 preferably comprises a photosensitive resin. The resin, when cured, should have a hardness of no more than about 60 Shore D. The hardness is measured on an unpatterned photopolymer resin coupon measuring about 1 inch by 2 inches by 0.025 inches thick cured under the same conditions ms the web patterning layer 250. The hardness measurement is made at 85 degrees Centigrade and read 10 seconds after initial engagement of the Shore D durometer probe with the resin.

Web patterning layers 250 having a wide variety of shapes and sizes can be formed with photosensitive resins. Suitable photosensitive resins include polymers which cure or cross-link under the influence of radiation. U.S. Pat. No. 4,514,345 issued Apr. 30, 1985 to Johnson et al. is incorporated herein by reference for the purpose of disclosing suitable photosensitive resins and a method by which a photosensitive resin can be cured on the foraminous background element 220 to form the web patterning layer 250.

FIG. 11 show an embodiment of a web support apparatus 200 having a web patterning layer 250 suitable for making the paper structure 20 of FIG. 10. The web patterning layer 250 comprises a lattice network 290 and a plurality of discrete web patterning elements 254 disposed within at least some of a plurality of cells 292 formed by the lattice network 290. The lattice 290 in FIG. 13 comprises spaced apart bands 294 which intersect spaced apart bands 296 to form the cells 292. The bands 294 and/or the bands 296 can be unbroken, or alternatively, can be formed by a plurality of short, spaced apart segments. The bands 294 extend generally in the machine direction and the bands 296 extend generally in the cross-machine direction. In FIG. 11 the bands 294 and 296 are unbroken and intersect to form a continuous network lattice 290 having a continuous network web contacting top surface.

Papermaking Method Description

A paper structure 20 according to the present invention can be made with the papermaking apparatus shown in FIGS. 6–9. Referring to FIG. 7, the method of making the paper structure 20 of the present invention is initiated by depositing a slurry of papermaking fibers from a headbox 500 onto a foraminous, liquid pervious forming member, such as a forming belt 542, followed by forming an embryonic web of papermaking fibers 543 supported by the forming belt 542. The forming belt 542 can comprise a continuous Fourdrinier wire, or alternatively, can be made according to the teachings of U.S. Pat. No. 4,514,345 issued Apr. 30 to Johnson et. al, which patent is incorporated herein by reference, or the teaching of U.S. Pat. No. 5,245,025 issued to Trokhan.

It is anticipated that wood pulp in all its varieties will normally comprise the paper making fibers used in this invention. However, other cellulose fibrous pulps, such as cotton liners, bagasse, rayon, etc., can be used and none are disclaimed. Wood pulps useful herein include chemical pulps such as Kraft, sulfite and sulfate pulps as well as mechanical pulps including for example, ground wood, thermomechanical pulps and Chemi-ThermoMechanical Pulp (CTMP). Pulps derived from both deciduous and coniferous trees can be used.

Both hardwood pulps and softwood pulps as well as blends of the two may be employed. The terms hardwood pulps as used herein refers to fibrous pulp derived from the woody substance of deciduous trees (angiosperms): wherein softwood pulps are fibrous pulps derived from the woody substance of coniferous trees (gymnosperms). Hardwood pulps such as eucalyptus having an average file length of about 1.00 millimeter are particularly suitable for tissue webs described hereinafter, whereas northern softwood Kraft pulps having an average fiber length of about 2.5 millimeter are preferred. Also applicable to the present invention are fibers derived from recycled paper, which may contain any or all of the above categories as well as other non-fibrous materials such as fillers and adhesives used to facilitate the original paper making.

The paper furnish can comprise a variety of additives, including but not limited to fiber binder materials, such as wet strength binder materials, dry strength binder materials, and chemical softening compositions. Suitable wet strength binders include, but are not limited to, materials such as polyamide-epichlorohydrin resins sold under the trade name of Kymene® 557H by Hercules Inc., Wilmington, Del. Suitable temporary wet strength binders include but are not limited to modified starch binders such as National Starch 78-0080 marketed by National Starch Chemical Corporation, New York., N.Y. Suitable dry strength binders include materials such as carboxymethyl cellulose and cationic polymers such as ACCO® 711. The ACCO® family of dry strength materials are available form American Cyanamid Company of Wayne, N.J. Suitable chemical softening compositions are disclosed in U.S. Pat. No. 5,279,767 issued Jan. 18, 1994 to Phan et al. Suitable biodegradable chemical softening compositions are disclosed in U.S. Pat. No. 5,312,522 issued May 17, 1994 to Phan et al.

The embryonic web 543 is preferably prepared from an aqueous dispersion of papermaking fibers, though dispersions in liquids other than water can be used. The fibers are dispersed in the carrier liquid to have a consistency of from about 0.1 to about 0.3 percent. The percent consistency of a dispersion, slurry, web, or other system is defined as 100 times the quotient obtained when the weight of dry fiber in the system under consideration is divided by the total weight of the system. Fiber weight is always expressed on the basis of bone dry fibers.

The embryonic web 543 can be formed in a continuous papermaking process, as shown in FIG. 7, or alternatively, a batch process, such as a handsheet making process can be used. After the dispersion of papermaking fibers is deposited onto the forming belt 542, the embryonic web 543 is formed by removal of a portion of the aqueous dispersing medium by techniques well known to those skilled in the art. The embryonic web can be generally monoplanar. Vacuum boxes, forming boards, hydrofoils, and the like are useful in effecting water removal from the dispersion. The embryonic web 543 travels with the forming belt 542 about a return roll 502 and is brought into the proximity of the web support apparatus 200.

The next step in making the paper structure 20 comprises transferring the embryonic web 543 from the forming belt 542 to the web support apparatus 200 and supporting the embryonic web 543 on the first side 202 of the web support apparatus. The embryonic web preferably has a consistency of at least 8 percent at the point of transfer to the forming belt 542. The step of transferring the embryonic web 543 can simultaneously include the step of deflecting a portion of the web 543 and removing water from the web 543. Alternatively, the step of deflecting a portion of the web 543 can follow the step of transferring the web.

Referring to FIGS. 7 and 8, the step of deflecting the web 543 comprises deflecting a portion of the web 543 in a first deflection step to form a non-monoplanar web 545 having a first uncompacted web region 547 supported on the first web contacting surface 230 at the elevation 231, and a second uncompacted web region 549 supported on the second web contacting surface 260 at the elevation 261. The first uncompacted web region 547 can comprise a dedensified or otherwise rebulked region 548 corresponding to the portions of the uncompacted web region 547 that are drawn or otherwise urged at least part way into the openings 221 in the foraminous background element 220. The thickness of the region 548 is generally greater than the thickness of those portions of the region 547 overlying each knuckle 232.

In the embodiment shown in FIG. 8 the non-monoplanar web 545 is formed by deflecting the fibers in the embryonic web 543 which overly the foraminous background element 220 of the web support apparatus 200. This first deflection step is preferably performed at a web consistency of between about 8 percent and about 30 percent, and more preferably at a web consistency of between about 10 percent and about 20 percent, so that deflection of the web takes place when the fibers of the web 543 are relatively mobile, and so that the deflection does not result in breaking of substantial numbers of fiber to fiber bonds.

The steps of transferring the embryonic web 543 to the web support apparatus 200 and deflecting the web 543 to form a non-planar web 545 can be provided, at least in part, by applying a differential fluid pressure to the embryonic web 543. For instance, the embryonic web 543 can be vacuum transferred from the forming belt 542 to the web support apparatus 200 by a vacuum source, such as vacuum box 600 shown in FIG. 7. One or more additional vacuum sources 620 can also be provided downstream of the embryonic web transfer point. The pressure differential across the embryonic web 543 provided by the vacuum source deflects the fibers overlying the foraminous background element 220, and preferably removes water from the web through the foraminous background element 220 to increase the consistency of the web to between about 15 and about 30 percent.

The pressure differential provided by the vacuum source can be between about 7 inches of mercury to about 25 inches of mercury. The pressure differential provided by the vacuum source permits transfer and deflection of the embryonic web without compaction of the web. U.S. Pat. No. 4,529,480 issued Jul. 16, 1985 to Trokhan is incorporated herein by reference for the purpose of teaching transfer of an embryonic web and deflection of a portion of a web by applying a differential fluid pressure.

The next step in forming the paper structure 20 can comprise pre-drying the non-monoplanar web 545, such as with a through-air dryer 650 shown in FIG. 7. The non-monoplanar web 545 is carried through the through-air dryer while supported on the web support apparatus 200. The non-monoplanar web can be pre-dried by directing a drying gas, such as heated air, through the non-monoplanar web 545. In one embodiment, the heated air is directed first through the non-monoplanar web 545, and subsequently through the foraminous background element 220 of the web support apparatus 200. The non-monoplanar web 545 preferably exits the dryer 650 at a consistency of between about 50 and about 80 percent. U.S. Pat. No. 3,303,576 issued May 26, 1965 to Sisson and U.S. Pat. No. 5,274,930 issued Jan. 4, 1994 to Ensign et al. are incorporated herein by reference for the purpose of showing suitable through air dryers for use in practicing the present invention.

After predrying the web 545 is carried on the web support apparatus 200 through a nip 670 provided between a compaction surface 675 and a deformable compression surface 910 of a press member. The compression member can comprise a roller 900. The web 545 is carried through the nip 670 for positioning of the web 545 adjacent the compaction surface 675, and for positioning the second side 204 of the web support apparatus 200 adjacent the deformable compression surface 910. The web 545 preferably enters the nip 670 at a consistency of between about 30 percent and about 80 percent and more preferably at a consistency of between about 40 percent and about 70 percent.

The compaction surface 675 is preferably characterized in having a relatively high hardness and in being relatively incompressible. A suitable surface 675 is the surface of a steel or iron heated dryer drum 680. The surface 675 can be coated with a creping adhesive dispensed from a spray nozzle 690 located upstream of the nip 670, or alternatively, by an impression roll (not shown). Alternatively, the creping adhesive can be applied to the non-monoplanar web 545 by any suitable means of glue application. A suitable creping adhesive is shown in U.S. Pat. No. 3,926,716 issued to Bates on Dec. 16, 1975, which patent is incorporated by reference.

The deformable compression surface 910 is preferably characterized in having a relatively low hardness and in being relatively highly compressible in comparison with the compaction surface 675. The roller 900 can have in inner core 902, an intermediate layer 904, and an outer layer 906, or alternatively, the layer 904 can be eliminated. The roller 900 can have a diameter of about 1–3 feet, and the dryer drum 680 can have a diameter of about 12–18 feet. The deformable compression surface 910 is preferably located on a layer 906 formed from a material having a compressive modulus of less than about 1.5 million kPa. In one embodiment, the inner core 902 can be formed from a material such as steel, the intermediate layer 904 can be formed from an elastomeric material, and the outer layer 906 comprising the surface 910 can be formed from a heat resistant elastomeric material such as nitril rubber. The hardness of the surface 910 is less than 120 P&J, preferably between about 30 P&J and 100 P&J. The procedure for measuring the P&J hardness of a roll surface is provided below.

Referring to FIG. 9, the next step in forming the paper structure 20 comprises pressing the web support apparatus 200 and the non-monoplanar web 545 between the compression surface 910 and the compaction surface 675 to provide a nip compression pressure of at least about 100 psi, and preferably at least about 200 psi. The nip pressure is the total force applied to the nip divided by the nip area. The total force applied to the nip can be determined from hydraulic gauge readings coupled with a force balance analysis based on the equipment geometry. The nip width is determined by loading the nip 670 with a sheet of white paper and a sheet of carbon paper positioned between the apparatus 200 and the surface 675, such that the carbon paper provides an impression of the nip width on the white paper.

Pressing the web support apparatus 200 and the non-monoplanar web 545 in the nip 670 provides a second deflection step. The second deflection step comprises deflecting the first web contacting surface 230 relative to the second web contacting surface 260. In particular, the first web contacting surface 230 is deflected toward the compaction surface 675 by the deformable compression surface 910, as shown in FIG. 9, thereby temporarily reducing, and preferably temporarily substantially eliminating the difference in elevation 262 between the web contacting surfaces 230 and 260.

Deflecting the first web contacting surface 230 relative to the second web contacting surface 260 provides deflection of a portion of the first uncompacted web region 547 relative to the second uncompacted web region 549, thereby reducing the difference in elevation between the first and second uncompacted web regions 547 and 549. In particular, the first uncompacted web region 547 is deflected toward the compaction surface 675 by the first web contacting surface 230, to thereby reduce the difference in elevation between a portion of the first uncompacted web region 547 and a portion of the second uncompacted web region 549 to about zero. The second deflection step is preferably performed at a web consistency of between about 30 percent and about 80 percent, and more preferably at a web consistency of between about 40 percent and about 70 percent.

Pressing the web support apparatus 200 and the non-monoplanar web 545 in the nip 670 also provides a web compaction step. Compaction provides a reduction in the thickness of the portion of the web which is compacted. The web compaction step comprises the step of compacting a predetermined portion of the first uncompacted web region 547 against the compaction surface 675 to form the first region 30. In particular, the first uncompacted web region 547 can be locally compacted by the discrete web compaction knuckles 232 to form the discrete protuberances 34. The web compaction step also comprises the step of compacting at least a portion of the second uncompacted web region 549 against the compaction surface 675 to form the second region 50. In particular, a portion of the second uncompacted web region 549 is compacted by the second web contacting surface 260 of the web patterning layer 250, as shown in FIG. 9. The difference in elevation between the first region 30 and the second region 50 is essentially zero at the end of the compaction step, as both of the regions 30 and 50 are pressed against the compaction surface 675 by the first and second web contacting surfaces 230 and 260, respectively.

The web support apparatus 200 having a web patterning layer 250 with the above described projected area, and disposed to inscribe large portions of the foraminous background element 220 is relatively flexible. Such flexibility permits the deflection of the first web contacting surface 230 relative to the second web contacting surface 260 required for the second deflection step and the compaction step described above, so that at the end of the second deflection step and the compaction step, the first and second regions 30 and 50 are imprinted against the surface 675, as shown in FIG. 9, and the difference in elevation between the first region 30 and the second region 50 is essentially zero.

Another factor which affects relative deflection of the surfaces 230 and 260 is the hardness of the web patterning layer 250. A resin having a low hardness when cured will be compressed to some degree in the nip 670, thereby reducing the difference in elevation between the surfaces 260 and 230. Relative deflection of the surfaces 230 and 260 is also enhanced by reducing the hardness of the compression surface 910. A relatively low hardness compression surface 910 can conform to a deflected foraminous background element 200, and thereby provide a compressive load intermediate the web patterning elements 254 to press the first web contacting surface 230 and the first uncompacted web region 547 toward the compaction surface 675.

The step of compacting a predetermined portion of the first uncompacted web region 547 to form the first region 30 preferably also comprises the step of adhering at least a portion of the first region 30 to the compaction surface 675. In particular, the discrete protuberances 34 can be adhered to the surface 675, as shown in FIG. 9, while the relatively low density third region 70 remains spaced from, and unattached to, the surface 675. The resulting partially compacted web is indicated by reference numeral 560 in FIGS. 7 and 9. The protuberances 34 can be adhered to the surface 675 by the adhesive sprayed on the surface 675 by the nozzle 690. The step of compacting the second uncompacted web region 549 to form the second region 50 preferably also comprises the step of adhering at least a portion of the region 50 to the compaction surface 675, as shown in FIG. 9. After the compaction step, the partially compacted web 560 is dried on the heated surface 675 to have a consistency of between about 85 percent and 100 percent.

The final step in forming the structure 20 comprises restoring at least some of the difference in web elevation lost in the second deflection step. This restoring step provides the first region 30 at the first elevation 32 and the second region 50 at the second elevation 52, wherein the difference 62 between the first elevation 32 and the second elevation 52 is greater than the reduced difference in elevation between the first and second uncompacted web regions 547 and 549 provided by the second deflection step.

The step of restoring some of the difference in web elevation lost in the second deflection step preferably comprises releasing the partially compacted web 560 from the compaction surface 675. In a preferred embodiment the step of restoring some of the difference in web elevation comprises foreshortening the partially compacted web 560 concurrently with, or subsequent to, the step of releasing the partially compacted web from the compaction surface 675. Preferably, the step of releasing and foreshortening the partially compacted web 560 comprises the step of creping the partially compacted web 560 from the surface 675 with a doctor blade 700 to provide the paper structure 20.

As used herein, foreshortening refers to the reduction in length of the partially compacted web 560 which occurs when energy is applied to the dry web in such a way that the length of the web is reduced in the machine direction. Foreshortening can be accomplished in any of several ways. The most common and preferred way to foreshorten a web is by creping. The partially compacted web 560 adhered to the compaction surface 675 is removed from the surface 675 by the doctor blade 700. In general, the doctor blade has a bevel angle of about 25 degrees and is positioned with respect to the Yankee dryer to provide an impact angle of about 81 degrees.

ANALYTICAL PROCEDURES

Measurement of Thickness and Elevation

The thicknesses and elevations of various regions 30–90 of a sample of the fibrous structure 20 are measured from microtomes made from cross-sections of the paper structure 20. A sample measuring about 2.54 centimeters by 5.1 centimeters (1 inch by 2 inches) is provided and stapled onto a rigid cardboard holder. The cardboard holder is placed in a silicon mold. The paper sample is immersed in a resin such as Merigraph photopolymer manufactured by Hercules, Inc.

The sample is cured to harden the resin mixture. The sample is removed from the silicon mold. Prior to immersion in photopolymer the sample is marked with a reference point to accurately determine where microtome slices are made. Preferably, the same reference point is utilized in both the plan view and various sectional views of the sample of the fibrous structure 20.

The sample is placed in a model 860 microtome sold by the American Optical Company of Buffalo, N.Y. and leveled. The edge of the sample is removed from the sample, in slices, by the microtome until a smooth surface appears.

A sufficient number of slices are removed from the sample, so that the various regions 30–90 may be accurately reconstructed. For the embodiment described herein, slices having a thickness of about 60 microns per slice are taken from the smooth surface. Multiple slices may be required so that the thicknesses 31, 51, 71, and 91 may be ascertained.

A sample slice is mounted on a microscope slide using oil and a cover slip. The slide and the sample are mounted in a light transmission microscope and observed at about 40× magnification. Photomicrographs are taken along the slice, and the individual photomicrographs are arranged in series to reconstruct the profile of the slice. The thicknesses and elevations may be ascertained from the reconstructed profile, as shown in FIGS. 2A and 2B. By knowing the relative basis weights of individual regions, as well as the corresponding thicknesses of the individual regions, the density of the individual regions can be ascertained. U.S. Pat. No. 5,277,761 issued Jan. 11, 1994 in the name of Phan et al. is incorporated herein by reference for describing the micro basis weight of individual regions of a paper structure.

The thicknesses 31–91 may be established by using Hewlett Packard ScanJet IIC color flatbed scanner. The Hewlett Packard Scanning software is DeskScan II version 1.6. The scanner settings type is black and white photo. The path is LaserWriter NT, NTX. The brightness and contrast setting is 125. The scaling is 100%. The file is scanned and saved in a picture file format on a Macintosh IICi computer. The picture file is opened with a suitable photo-imaging software package or CAD program, such as PowerDraw version 5.0.

Referring to FIGS. 2A and 2B, the thickness of each region can be determined by drawing a circle which is inscribed by the region. The thickness of the region at that point is the diameter of the smallest circle that can be drawn in the region (in the microtome sample), multiplied by the appropriate scale factor. The scale factor is the magnification of the photomicrograph multiplied by the magnification of the scanned image. The circle can be drawn using any appropriate software drawing package, such as PowerDraw, version 5.0, available from Engineered Software of N.C.

The difference in elevation 62 is measured by drawing the smallest circle inscribed by region 50 (in the microtome sample), and by drawing two circles inscribed by region 30, as shown in FIGS. 2A and 2B. A first line L1 is drawn tangent to the two circles inscribed by region 30. A second line L2 is drawn parallel to the first line L1 and tangent to circle inscribed by region 50. The distance between the first and second lines, multiplied by the appropriate scale factor, is the difference in elevation 62.

Projected Area Measurement

The projected area of the web contacting surface 260 is measured according to the following procedure. First, the web contacting surface 260 is darkened with a black marker (Sanford Sharpie) to increase the contrast. Second, three digitized images of the web patterning apparatus 200 are acquired using a Hewlett Packard ScanJet IIc Flatbed scanner. The scanner options are set as follows: Brightness 198, contrast 211, black and white photo resolution 100 DPI, scaling 100%. Third, the percentage of the projected area of the web support apparatus 200 comprising the web contacting surface 260 is determined using a suitable image analysis software system such as Optimas available from Bioscan, Incorporated, Edmonds, Wash. The ratio of the number of pixels having a greyscale value between 0 and 62 (corresponding to the web contacting surface 260) is divided by the total number of pixels in the scanned image (times 100) to determine the percentage of the projected area of the web support apparatus 200 comprising the web contacting surface 260.

Measurement of Web Support Apparatus Elevations

The elevation difference 262 between the elevation 231 of the first web contacting surface 230 and the elevation 261 of the second web contacting surface 260 is measured using the following procedure. The web support apparatus is supported on a flat horizontal surface with the web patterning layer facing upward. A stylus having a circular contact surface of about 1.3 square millimeters and a vertical length of about 3 millimeters is mounted on a Federal Products dimensioning gauge (model 432B-81 amplifier modified for use with an EMD-4320 Wl breakaway probe) manufactured by the Federal Products Company of Providence, R.I. The instrument is calibrated by determining the voltage difference between two precision shims of known thickness which provide a known elevation difference. The instrument is zeroed at an elevation slightly lower than the first web contacting surface 230 to insure unrestricted travel of the stylus. The stylus is placed over the elevation of interest and lowered to make the measurement. The stylus exerts a pressure of about 0.24 grams/square millimeter at the point of measurement. At least three measurements are made at each elevation. The difference in the average measurements of the individual elevations 231 and 261 is taken as the elevation difference 262.

Measurement of P&J Hardness

The surface hardness of the roll 900 is measured using a P&J plastometer Model 2000 manufactured by Dominion Engineering Works LTD of Lachine, Quebec, Ontario. The indentor shaft has a 3.17 millimeter ball. The hardness is taken at three different positions: One in the middle of the roll, one 6 inches from one end of the roll, and one 6 inches from the other end of the roll. The P&J hardness is the average of these three readings. The readings are made with the roll conditioned at a temperature of 21 degrees Celsius following the procedure provided by the manufacturer of the plastometer.

EXAMPLES

The following examples are provided to illustrate papermaking according to the present invention.

EXAMPLE 1

A 3% by weight aqueous slurry of NSK is made up in a conventional re-pulper. The NSK slurry is refined gently and a 2% solution of the temporary wet strength resin (i.e., National starch 78-0080 marketed by National Starch and Chemical corporation of New York, N.Y.) is added to the NSK stock pipe at a rate of 0.02% by weight of the dry fibers. The NSK slurry is diluted to about 0.2% consistency at the fan pump. Second, a 3% by weight aqueous slurry of Eucalyptus fibers is made up in a conventional re-pulper. The Eucalyptus slurry is diluted to about 0.2% consistency at the fan pump.

Three individually treated furnish streams (stream 1=100% NSK; stream 2=100%. Eucalyptus; stream 3=100% Eucalyptus) are kept separate through the headbox and deposited onto a Fourdrinier wire to form a three layer embryonic web containing two outer Eucalyptus layers and a middle NSK layer. Dewatering occurs through the Fourdrinier wire and is assisted by a deflector and vacuum boxes. The Fourdrinier wire is of a 5-shed, satin weave configuration having 110 machine-direction and 95 cross-machine-direction monofilaments per inch, respectively.

The embryonic wet web is vacuum transferred from the Fourdrinier wire, at a fiber consistency of about 8% at the point of transfer, to the web support apparatus 200 having a foraminous background element 220 and a web patterning layer 250 made of photosensitive resin. A pressure differential of about 16 inches of mercury is used to transfer the web to the web support apparatus 200. The foraminous background element is of a 5-shed, satin weave configuration having 59 machine-direction and 44 cross-machine-direction monofilaments per inch, the machine direction filaments having a diameter of about 0.25 mm and the cross-machine direction filaments having a diameter of about 0.33 mm. Such a foraminous background element is manufactured by Appleton Wire Company, Appleton, Wis.

The web patterning layer 250 has web contacting top surface with a projected area which is between about 10 and about 12 percent of the projected area of the apparatus 200. The difference in elevation 262 is about 0.010 inch (0.254 mm). The web patterning layer comprises discrete web patterning elements as shown in FIG. 5. The web support apparatus 200 has an air permeability of about 600 scfm.

The multi-elevation web is formed at the vacuum transferred point. Further dewatering is accomplished by vacuum assisted drainage and by though air drying, as represented by devices 600, 620, and 650 until the web has a fiber consistency of about 65%. Transfer to the Yankee dryer is effected with a soft pressure roll 900 having a surface hardness of about 40 P&J. The web is then adhered to the surface 675 of the a Yankee dryer drum 680 by pressing the soft pressure roll to the Yankee dryer surface at a compression pressure of at least about 40 psi. A Polyvinyl alcohol based creping adhesive is used to enhance the adhesion of the web to the surface 675. The web consistency is increased to between about 90% and 100% before dry creping the web from the surface 675 with a doctor blade. The doctor blade has a bevel angle of about 25 degrees and is positioned with respect to the Yankee dryer to provide an impact angle of about 81 degrees; the Yankee dryer is operated at about 800 rpm (feet per minute) (about 244 meters per minute). The dry web is formed into roll at a speed of 650 fpm (200 meters per minutes).

The web made according to the above procedure is convened into a three-layer, one-ply toilet tissue paper. The one-ply toilet tissue paper has a basis weight of about 18 pounds per 3000 square feet, and contains about 0.02% of the temporary wet strength resin. Importantly, the resulting one-ply tissue paper is soft, absorbent and has attractive aesthetics suitable for use as toilet tissue.

EXAMPLE 2

A 3% by weight aqueous slurry of NSK is made up in a conventional re-pulper. The NSK slurry is refined gently and a 2% solution of the permanent wet strength resin (i.e., Kymene® 557H marketed by Hercules Incorporated of Wilmington, Del.) is added to the NSK stock pipe at a rate of 0.02% by weight of the dry fibers followed by the addition of a 1% solution of the dry strength resin (i.e., CMC from Hercules Incorporated of Wilmington, Del.)is added to the NSK stock before the fan pump at a rate of 0.08% by weight of the dry fibers. The NSK slurry is diluted to about 0.2% consistency at the fan pump. Second, a 3% by weight aqueous slurry of Eucalyptus fibers is made up in a conventional re-pulper. The Eucalyptus slurry is diluted to about 0.2% consistency at the fan pump.

Two individually treated furnish streams (stream 1=100% NSK/stream 2=100% Eucalyptus) are kept separate through the headbox and deposited onto a Fourdrinier wire to form a two layer embryonic web containing equal portions of NSK and Eucalyptus. Dewatering occurs through the Fourdrinier wire and is assisted by a deflector and vacuum boxes. The Fourdrinier wire is of a 5-shed, satin weave configuration having 110 machine-direction and 95 cross-machine-direction monofilaments per inch, respectively.

The embryonic wet web is transferred from the Fourdrinier wire, at a fiber consistency of about 8% at the point of transfer, to a web support apparatus having a foraminous background element 220 having web patterning layer 250. The embryonic wet web is transferred from the Fourdrinier wire, at a fiber consistency of about 8% at the point of transfer, to the web support apparatus 200 having a foraminous background element 220 and a web patterning layer 250 made of photosensitive resin. A pressure differential of about 16 inches of mercury is used to transfer the web to the web support apparatus 200. The foraminous background element is of a 3-shed, satin weave configuration having 79 machine-direction and 67 cross-machine-direction monofilaments per inch, the machine direction filaments having a diameter of about 0.18 mm and the cross-machine direction filaments having a diameter of about 0.21 mm. Such a foraminous background element is manufactured by Appleton Wire Company, Appleton, Wis.

The web patterning layer 250 has web contacting top surface 60 having a projected area which is between about 10 and about 12 percent of the projected area of the apparatus 200. The difference in elevation 262 is about 0.010 inch (0.254 mm). The web patterning layer comprises discrete web patterning elements as shown in FIG. 5. The web support apparatus 200 has an air permeability of about 500 scfm.

The multi-elevation web is formed at the vacuum transferred point. Further dewatering is accomplished by vacuum assisted drainage and by though air drying, as represented by devices 600, 620, and 650 until the web has a fiber consistency of about 65%. Transfer to the Yankee dryer is effected with a soft pressure roll 900 having a surface hardness of about 40 P&J. The web is then adhered to the surface 675 of the a Yankee dryer drum 680 by pressing the soft pressure roll to the Yankee dryer surface at a compression pressure of at least about 40 psi. A Polyvinyl alcohol based creping adhesive is used to enhance the adhesion of the web to the surface 675. The web consistency is increased to between about 90% and 100% before dry creping the web from the surface 675 with a doctor blade. The doctor blade has a bevel angle of about 25 degrees and is positioned with respect to the Yankee dryer to provide an impact angle of about 81 degrees; the Yankee dryer is operated at about 800 rpm (feet per minute) (about 244 meters per minute). The dry web is formed into roll at a speed of 650 fpm (200 meters per minutes).

The web is converted to provide a two-layer, two-ply facial tissue paper. Each ply has a basis weight of about 10 pounds per 3000 square feet and contains about 0.02% of the permanent wet strength resin and about 0.08% of the dry strength resin. The resulting two-ply tissue paper is soft, absorbent and has attractive aesthetics suitable for use as facial tissues.

What is claimed:

1. A method of forming a paper structure comprising the steps of:

providing a wet web of paper making fibers;

deflecting the web in a first deflection step to provide a non-monoplanar web having a first uncompacted web region, and a second uncompacted web region having an elevation different from the elevation of the first uncompacted web region while the web has a consistency of between about 8 and about 30 percent;

deflecting the first uncompacted web region relative to the second uncompacted web region in a second deflection step to temporarily reduce the difference in elevation between the first uncompacted web region and the second uncompacted web region;

compacting a predetermined portion of the first uncompacted web region at a web consistency of between about 40 to about 80 percent to provide a first compacted region and a third uncompacted region;

compacting at least a portion of the second uncompacted web region at a web consistency of between about 40 to about 80 percent to form a second compacted web region; and restoring at least some of the difference in elevation lost in the second deflection step to provide the first compacted region at an elevation different from the elevation of the second compacted region.

2. The method of claim 1 further comprising the step of foreshortening the web after compacting the web.

3. The method of claim 1 comprising the step of imparting a variable frequency crepe pattern to a portion of the web bordering at least a portion of the second compacted web region.

4. The method of claim 1 wherein the step of compacting the first uncompacted web region comprises forming a first compacted web region comprising a plurality of discrete compacted protuberances dispersed throughout the third uncompacted region.

5. The method of claim 1 wherein the step of deflecting the web in the first deflection step comprises providing a differential fluid pressure across the thickness of the web.

6. A method of forming a paper structure comprising the steps of:

providing an uncompacted, generally monoplanar web of paper making fibers;

providing a web support apparatus comprising a foraminous background element having a first web contacting surface and a web patterning layer joined to the foraminous background element, the web patterning layer extending from the first web contacting surface to form a second web contacting surface at an elevation different from the elevation of the first web contacting surface, and the web patterning layer inscribing a plurality of circular portions of the foraminous background element, each of the inscribed circular portions of the foraminous background element having a projected area of at least 50 square millimeters;

supporting the web on the web support apparatus;

deflecting a portion of the web to form a non-monoplanar web having a first uncompacted web region supported on the first web contacting surface at an elevation different from an elevation of a second uncompacted web region supported on the second web contacting surface while the web has consistency of between about 8 and about 30 percent;

providing a compaction surface;

positioning the web intermediate the web support apparatus and the compaction surface;

deflecting the first web contacting surface relative to the second web contacting surface in a second deflection step to reduce the difference in elevation between the first uncompacted web region and the second uncompacted web region;

compacting a predetermined portion of the first uncompacted web region between the first web contacting surface and the compaction surface to form a first compacted region comprising a plurality of discrete compacted protuberances dispersed throughout a relatively uncompacted region;

compacting at least a portion of the second uncompacted web region between the second web contacting surface and the compaction surface to form a second compacted region;

drying the web to a consistency of at least about 90 percent; and creping the web from the compaction surface.

* * * * *

UNITED STATES PATENT AND TRADEMARK OFFICE

CERTIFICATE OF CORRECTION

PATENT NO. : 5,609,725

DATED : March 11, 1997

INVENTOR(S) : DEAN VAN PHAN

It is certified that error appears in the above-indentified patent and that said Letters Patent is hereby corrected as shown below:

Column 5, line 30, "Further" should read -- further --.

Column 5, line 56, "he" should read -- be --.

Column 6, line 43, "For" should read -- for --.

Column 6, line 59, "From" should read -- from --.

Column 10, line 46, "file" should read -- fiber --.

Column 12, line 42, "predrying" should read -- predrying, --.

Column 17, line 36, "2=100%." should read -- 2=100% --.

Column 18, line 19, "rpm" should read -- fpm --.

Column 18, line 24, "convened" should read -- converted --.

Column 19, line 32, "rpm" should read -- fpm --.

Signed and Sealed this

Nineteenth Day of August, 1997

*Attest:*

*Attesting Officer*

BRUCE LEHMAN

*Commissioner of Patents and Trademarks*